US011585350B2

(12) United States Patent
Canipe et al.

(10) Patent No.: US 11,585,350 B2
(45) Date of Patent: Feb. 21, 2023

(54) MOBILE CLIMATE CONTROL ASSEMBLY AND METHOD OF USE

(71) Applicant: Cleva Technologies, LLC, Boca Raton, FL (US)

(72) Inventors: Larry K. Canipe, Boca Raton, FL (US); Raymund F. Vivar, Deerfield Beach, FL (US)

(73) Assignee: CLEVA TECHNOLOGIES, LLC, Boca Raton, FL (US)

( * ) Notice: Subject to any disclaimer, the term of this patent is extended or adjusted under 35 U.S.C. 154(b) by 0 days.

(21) Appl. No.: 17/430,221

(22) PCT Filed: Feb. 11, 2020

(86) PCT No.: PCT/US2020/017801

§ 371 (c)(1),
(2) Date: Aug. 11, 2021

(87) PCT Pub. No.: WO2020/167873

PCT Pub. Date: Aug. 20, 2020

(65) Prior Publication Data

US 2022/0163040 A1 May 26, 2022

Related U.S. Application Data

(60) Provisional application No. 62/804,093, filed on Feb. 11, 2019.

(51) Int. Cl.
*F04D 25/10* (2006.01)
*F04D 17/04* (2006.01)
(Continued)

(52) U.S. Cl.
CPC ..... *F04D 25/10* (2013.01); *F04D 17/04* (2013.01); *F04D 29/4213* (2013.01);
(Continued)

(58) Field of Classification Search
CPC ..... F04D 17/04; F04D 25/10; F04D 25/166
See application file for complete search history.

(56) References Cited

U.S. PATENT DOCUMENTS 2,258,284 A 10/1941 Findley
5,497,633 A 3/1996 Jones et al.
(Continued)

*Primary Examiner* — J. Todd Newton
*Assistant Examiner* — Brian O Peters
(74) *Attorney, Agent, or Firm* — Mark C. Johnson; Johnson Dalal

(57) ABSTRACT

A mobile climate control assembly that includes a portable housing with a first fan blower-wheel assembly and a second fan blower assembly each respectively having a wheel blade member, partially surrounded by an air deflector wall, disposed within a housing cavity and operably configured to rotate 360° around an axis of rotation parallel and non-coplanar with respect to one another. The assembly also includes a fan motor operably coupled to the wheel blade members and an electronic controller electronically and communicatively coupled to the fan motor and operably configured to independently and selectively control rotation of the wheel member of each of the first and second fan blower-wheel assemblies to generate an ambient air velocity gradient along at least an approximate 90° angular traverse path from the front face and without rotation of the portable housing.

18 Claims, 8 Drawing Sheets

(51) Int. Cl.
*F04D 29/42* (2006.01)
*F04D 29/46* (2006.01)
*F24F 5/00* (2006.01)

(52) U.S. Cl.
CPC ..... *F04D 29/462* (2013.01); *F24F 5/0035* (2013.01); *F24F 2221/125* (2013.01)

(56) References Cited

U.S. PATENT DOCUMENTS

| | | | | |
|---|---|---|---|---|
| 6,293,121 | B1 | 9/2001 | Labrador | |
| 6,321,034 | B2 | 11/2001 | Jones-Lawlor et al. | |
| 6,340,283 | B1 * | 1/2002 | Hedger | F04D 25/166 416/246 |
| 6,953,322 | B2 | 10/2005 | Lim | |
| 7,059,826 | B2 | 6/2006 | Lasko | |
| 9,459,022 | B2 | 10/2016 | Krupp et al. | |
| 9,964,324 | B2 | 5/2018 | Taira et al. | |
| 10,054,128 | B2 | 8/2018 | Furuhashi et al. | |
| 2003/0111746 | A1 * | 6/2003 | Stutts | F24F 5/0035 261/116 |
| 2005/0123392 | A1 | 6/2005 | Belsito et al. | |
| 2016/0123605 | A1 * | 5/2016 | Son | F24F 1/0011 165/122 |

* cited by examiner

MOBILE CLIMATE CONTROL ASSEMBLY AND METHOD OF USE

CROSS-REFERENCE TO RELATED APPLICATION

This is a national stage entry of PCT application no. PCT/US20/17801, filed Feb. 11, 2020, which claims priority to U.S. Provisional Patent Application No. 62/804,093, filed Feb. 11, 2019, the entirety of which is incorporated by reference.

FIELD OF THE INVENTION

The present invention relates generally to mobile fan assemblies, and, more particularly, relates to mobile fan assemblies operably configured to generate an air velocity gradient and circulate air in an ambient environment.

BACKGROUND OF THE INVENTION

Whether located in an inside or outside environment, many users desire to control the ambient air temperature or airflow surrounding the users. Many known climate controlling devices and methods available to do so, however, are impracticable or inefficient for users located in mobile or remote environments. For example, some known devices and methods include employing the use of a rotatable fan blade that may or may not be encapsulated in a housing. Many, if not most, of these devices, however, are not designed or configured to create an evaporative cooling environment or control the directional flow of air in an ambient environment. The climate controlling devices that are configured to control directional flow of air or other gasses do so in an inefficient and/or impracticable manner.

One such climate controlling device for example, embodied in U.S. Pat. No. 6,321,034 (Nov. 20, 2001) issued to The Holmes Group, Inc., discloses the use of two blowers disposed in respective housings that are operably configured to rotate with respect to one another. The rotation of the two blower housings distributes flow of air in an ambient environment, but is limited in speed to effectuate flow and otherwise requires motors, bearings and other components required to effectuate the rotation (thereby making these devices more prone to failure, expensive, and heavier).

Therefore, a need exists to overcome the problems with the prior art as discussed above.

SUMMARY OF THE INVENTION

The invention provides a mobile climate control assembly and method of use that overcomes the hereinafore-mentioned disadvantages of the heretofore-known devices and methods of this general type and that enables computer-controlled airflow without any rotation of a fan housing.

With the foregoing and other objects in view, there is provided, in accordance with the invention, a mobile climate control assembly having a portable housing with a base coupled thereto, an upper end, a lower end opposing the upper end of the housing, a housing length separating the upper and lower ends, defining a housing cavity, a front face, and a rear face opposing the front face. The assembly also includes a first fan blower-wheel assembly and a second fan blower assembly each respectively having a wheel member and an air deflector wall. The wheel member is disposed within the housing cavity and with a plurality of wheel blades disposed circumferentially around the wheel member and operably configured to rotate 360° around an axis of rotation parallel and non-co-planar with respect to one another. The air deflector wall is coupled to the housing and surrounding a partial circumference of the wheel member and having a front end portion disposed proximal to the front face of the housing and configured to direct air generated from the wheel member outwardly away from the front face of the housing. The assembly also includes at least one fan motor operably coupled to the wheel member of each of the first and second fan blower-wheel assemblies. The assembly also includes an electronic controller communicatively coupled to the at least one fan motor and operably configured to independently and selectively control rotation of the wheel member of each of the first and second fan blower-wheel assemblies to generate an ambient air velocity gradient along at least an approximate 90° angular traverse path from the front face and without rotation of the portable housing. Although the invention is illustrated and described herein as embodied in a mobile climate controlled, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the housing of the mobile climate control assembly spanning from the upper end to the lower end of the housing, wherein the term "traverse" should be understood to mean in a direction approximately 90° with respect to the longitudinal direction. Said differently, longitudinal may be thought of as the y-axis, wherein traverse may be thought of as the x-axis. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
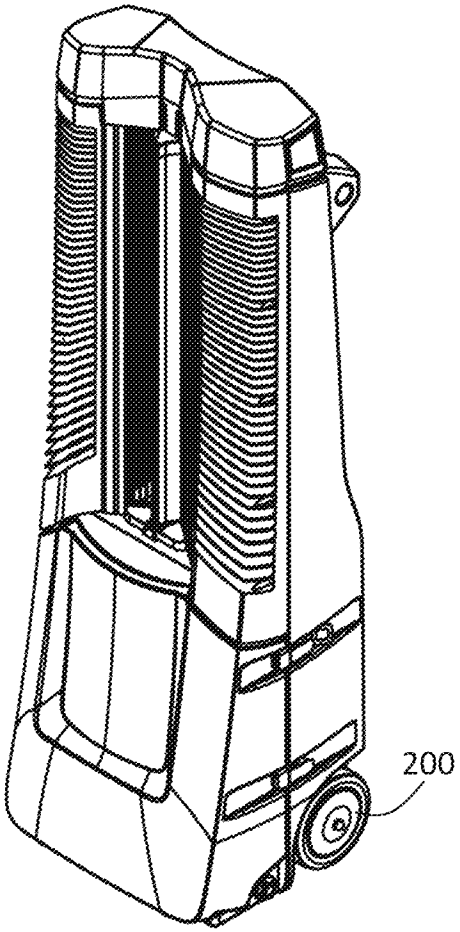
FIG. 2 is a perspective right-side front view of the mobile climate control assembly in FIG. 1.
Figure 1:
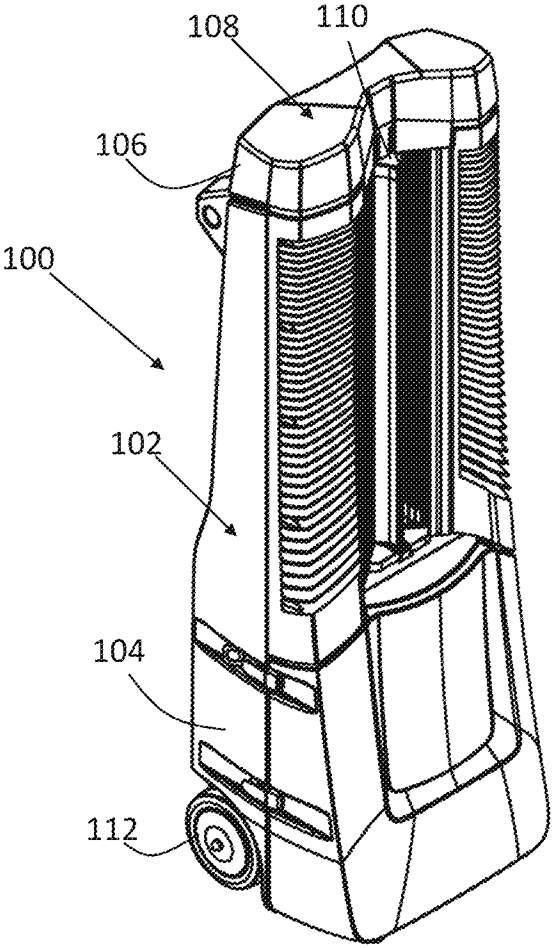
FIG. 1 is a perspective left-side front view of a mobile climate control assembly in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient mobile climate control assembly and method of use that utilizes computer-controlled wheel blower assemblies to selectively generate air flow across a wide angular range and at various velocities with little to no other moving parts. Embodiments of the invention provide an assembly and method to effectively and efficiently increase or decrease the ambient surrounding air for the comfort of users. As such, embodiments of the present invention generate oscillation of airflow using air convergence and vectoring employ the use of at least two crossflow or tangential fans disposed at angles with respect to each other. To effectuate the same, an electronic controller is operably coupled to motors on each of the fans, thereby offering users unlimited patterns of oscillated air flow up to approximately 160°.

Referring now to FIGS. 1-10, various views of one embodiment of the present invention are shown. The views show several advantageous features of the present invention, but, as will be described below, the invention can be provided in several shapes, sizes, combinations of features and components, and varying numbers and functions of the components. When describing the present invention, it should be understood that terms such as, "front," "rear," "side," top," "bottom," and the like are indicated from the reference point of a viewer viewing the assembly 100 as oriented, configured, and depicted in FIG. 5.

More specifically, the mobile climate control assembly 100 includes a portable housing 102 with a base 104 coupled thereto. The housing 102 includes an upper end 108, a lower end 1000 opposing the upper end 106 of the housing 102, a housing length 502 separating the upper and lower ends 108, 1000, a front face 500, and a rear face 600 opposing the front face 500. The housing 102 is preferably constructed of a waterproof, durable, substantially rigid, and lightweight material, e.g., ABS plastic or aluminum. The housing length or height 502 may be approximately 65-96 inches, wherein the width (i.e., side-to-side) and depth (rear face 600 to front face 500) may be approximately 20-25 inches and 16-25 inches, respectively. Other dimensions outside of those ranges are contemplated, however. The shape, size, and configuration of the housing 102, along with the configuration of air inlets and exists, generates a very small footprint operably configured to beneficially fit in rooms, corners, and areas of various sizes and dimensions. To that end, the depth of the housing 102 may be tapered in some embodiments to fit within room corners.

With reference to FIG. 1, FIG. 3, FIG. 6, and FIG. 10, the housing 102 may portable, i.e., it is able to easily be moved, maneuvered, and/or transported by hand or otherwise without any heavy machinery. To that end, the housing 102 portable in that it includes at least one wheel 112 disposed at the lower end 1000 and the rear face 600 of the housing 102. Preferably, there are two wheels 112, 200 disposed at opposing sides of the housing 102. The housing 102 may also beneficially include a handle member 300 disposed at the rear face 600 of the housing 102 and is configured for grasping as shown in the figures. As such, the housing 102 is operably configured to traverse up an approximate 5° slope and maintain stability on that slope. The housing 102 is also configured to be transported over a curb, turf, sand, asphalt, and other ground surfaces.

The housing 102 also defines a housing cavity 1604 that may be of a single opening or partitioned into various sub-cavities. In one embodiment, the housing cavity 1604 includes a selectively removable liquid basin 1104 formed in the base 104 of the housing 102. With reference to FIG. 1, FIGS. 3-4, FIG. 11, and FIG. 16, the liquid basin 1104 may be selectively removed and locked into a storage position using one or more fastener(s) 302, 400 disposed on the sides of the housing 102. The liquid basin 1104 may move on a track and may be in a watertight configuration with respect to the housing 102 when in the storage position. In one embodiment, the housing cavity 1604 can be accessed by selectively removing a cover 106 that may be rotatably coupled or otherwise coupled to the housing 102.

Figure 13:
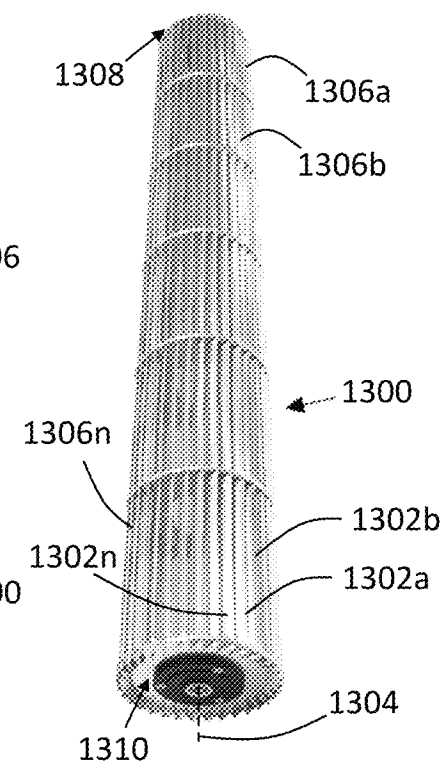
FIG. 13 is a perspective view of a wheel member of a fan blower-wheel assembly in accordance with one embodiment of the present invention.
Figure 12:
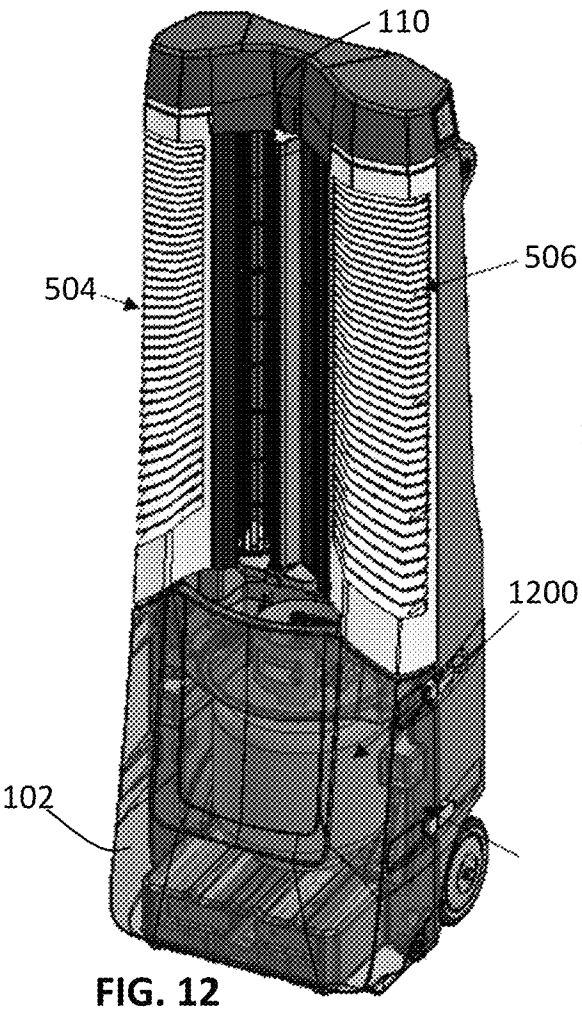
FIG. 12 is a partially transparent and perspective view of the mobile climate control assembly in FIG. 1 in accordance with one embodiment of the present invention.
Figure 11:
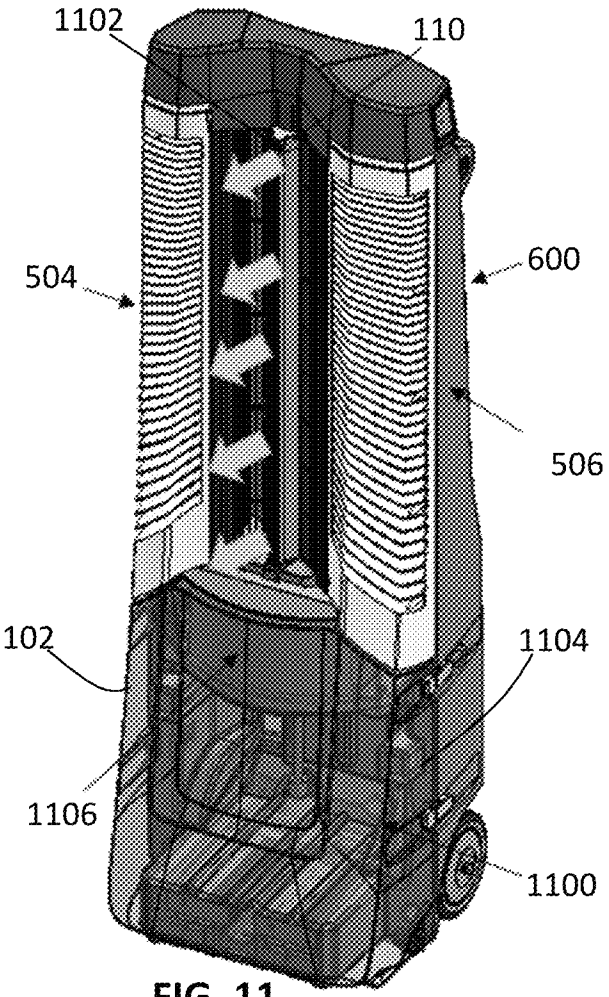
FIG. 11 is a partially transparent and perspective view of the mobile climate control assembly in FIG. 1 emitting a liquid vapor in accordance with one embodiment of the present invention.
Figure 14:
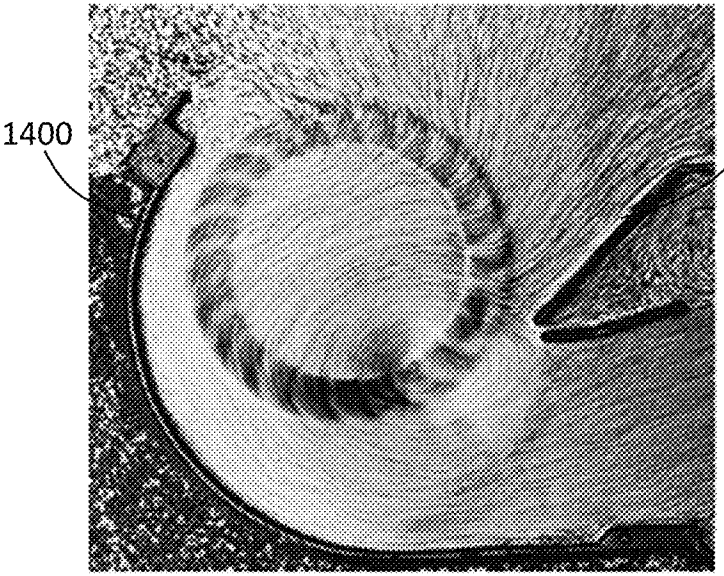
FIG. 14 is a top plan view of a wheel member of a fan blower-wheel assembly in an operational position and generating an air velocity in accordance with one embodiment of the present invention.
Figure 15:
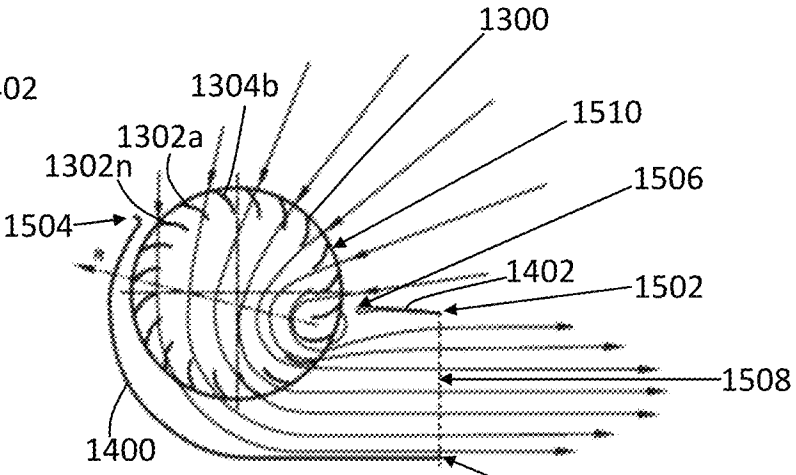
FIG. 15 is another top plan view of a wheel member of a fan blower-wheel assembly in an operational position and generating an air velocity in accordance with one embodiment of the present invention.

With reference to FIGS. 11-18, a first fan blower-wheel assembly 1600 and a second fan blower assembly 1602 are at least partially disposed within the housing cavity 1604 for access by a user. Each of the fan blower-wheel assemblies 1602, 1602 include a wheel member 1300 (also represented in FIG. 16 as numerals 1600,1602). The wheel members 1600, 1602 are disposed within the housing cavity 1604 and with a plurality of wheel blades 1302*a-n* disposed circumferentially around the wheel member 1300 and operably configured to rotate 360° around an axis of rotation 1304 parallel and non-co-planar with respect to one another (best seen in FIG. 16). In other embodiments, the axis of rotation for each wheel member 1300 may be both upright or disposed in a longitudinal or horizontal orientation, but not necessarily parallel to one another. The wheel blades 1302*a-n* may be of a substantially rigid material (e.g., aluminum or PVC plastic) and be spaced approximately 0.2-2 inches apart from one another and angled to generate a pressurized airflow through the wheel members 1600, 1602 (as best seen in FIGS. 14-15).

As best seen in FIG. 13, however, the fan blower-wheel assemblies 1602, 1602 may each include a plurality of serially aligned wheel members 1306*a-n* with the axis of rotation 1304 for each that is oriented in a longitudinal direction spanning along the housing length 502. The wheel members 1600,1602 (whether serially aligned or otherwise) may include a top end 1308, a bottom end 1310 opposing the top end 1308, and a wheel length 1312 separating the top and bottom ends 1308, 1310.

The wheel length 1312 may be at least approximately 50% of the housing length 502, but may be another length in other embodiments. The base 104 of the housing 102, can be seen off-setting the wheel members 1600,1602 approximately 1-2 feet from the ground surface, but may be of a different length in other embodiments.

To effectively and efficiently direct pressurized air generated from the wheel members 1600, 1602 to the ambient environment, an air deflector wall 1400 is employed. The air deflector wall 1400 is coupled to the housing 102 using one or more bracket(s) and surrounds a partial circumference of the wheel member 1300. In one embodiment, the air deflector wall 1400 spans the wheel length 1312 and substantially free of any holes and is of a smooth inner surface to reduce losses in air velocity. The air deflector wall 1400 includes a front-end portion 1500 disposed proximal to the front face 500 of the housing 102 and is configured to direct air generated from the wheel member 1300 outwardly away from the front face 500 of the housing 102 (as best depicted in FIGS. 14-18). As used herein, the term "wall" is intended broadly to encompass continuous structures, as well as, separate structures that are coupled together to form a substantially continuous external surface.

The assembly 100 also includes utilizing at least one fan motor 1900 operably coupled to the wheel member 1300 of each of the first and second fan blower-wheel assemblies 1600, 1602. In one embodiment, a single motor operably configured to provide independent rotation is employed (see, for example, Morgante, U.S. Pat. No. 7,030,528, and Qu et al., U.S. Patent Application Publication No. 2008/0142284. Other power transfer components and parts, e.g., linkages, gears, etc., may be utilized to effectively transfer mechanical work generated from motor to the wheel members 1600, 1602. In other embodiments, however, a first motor 1900 is operably coupled to a bottom end 1310 of the wheel member 1300 of the first fan blower-wheel assembly 1600 and a second motor 1904 is operably coupled to a bottom end 1310 of the wheel member 1300 of the second fan blower-wheel assembly 1602 for quick and efficient power transfer to each wheel member. The top end 1308 of the wheel members 1600,1602 may be rotationally coupled to housing 102, including the cover 106, using, for example, a bearing enabling the reduction of frictional losses. In other embodiments, the top end 1308 of the wheel members 1600,1602 may be structurally unattached and uncoupled to the housing 102. One exemplary operably coupled relationship between the fan motor and wheel member includes a shaft sized and shape to be inserted into a shaft channel defined on the bottom end 1310 of the wheel member. The coupling configuration between the fan motor and wheel member may be a tongue-and-groove configuration or other configuration enabling rotation of the wheel member.

As best seen in FIGS. 16-19, one or more electronic controller(s) 1902 are utilized to beneficially control rotation of each or both wheel members 1600, 1602 to generate a desired airflow path and/or airflow oscillation, without rotation of the housing 102. To effectuate the same, the electronic controller 1902 is communicatively coupled (and sometimes electrically coupled) to the at least one fan motor 1900. The communication may be carried out through a wired or wireless communication protocol, e.g., Bluetooth. The electronic controller 1902 is operably configured, through use of the one or more fan motors 1904, to independently and selectively control rotation of the wheel member 1300 of each of the first and second fan blower-wheel assemblies 1600, 1602 to generate an ambient air velocity gradient along at least an approximate (+/−15°) 90° angular traverse path from the front face 500 and without rotation of the portable housing 102. In preferred embodiments, the first and second fan blower-wheel assemblies 1600, 1602 are operably configured to generate an airflow along an approximate 110° angular traverse path. Said another way, the electronic controller 1902 may be configured to cause selectively rotation of the wheel members 1600, 1602 to generate airflow at any desired angle along a traverse path in front of the front face 500 of the housing 102.

With reference to FIGS. 5-7 and FIGS. 11-12, the housing 102 of the assembly 100 also includes a liquid reservoir 1100 defined by, and operably configured to house a liquid (e.g., water), therein. The liquid reservoir 1100 may be configured to house approximately 12-18 gallons of a liquid substance and may be selectively/continuously filled and drained using an exemplary intake port/cap 602 and drain port/plug 700, respectively. The housing 102 may also include a liquid emission bracket 110 coupled thereto and oriented and disposed longitudinally along the housing length 502 defining at least one liquid port or orifice 1102 thereon that is fluidly coupled to the liquid reservoir 1100. The liquid emission bracket 110 may be a selectively removable component retained on the housing 102 with a tongue-and-groove configuration and/or using one or more fastener(s). To that end, different liquid emission brackets 110 may be employed that include liquid port(s) 1102 of varying diameters or sizes to generate different sizes of water droplets, e.g., fog, mist, etc. The liquid emission bracket 110 may be integrally formed on the housing 102 in other embodiments and may include a selectively and/or computer-controlled diameters for the liquid port(s) 1102.

To cause emission of the liquid housed in the liquid reservoir 1100 (which may be located in and/or defined by the base 104), the assembly 100 may include a pump 1106 fluidly coupled to the liquid reservoir 1100 with, for example, one or more ducts or pipes. The pump 1106 is beneficially operably configured to induce a pressurized flow of the fluid housed in the liquid reservoir 1100 through the at least one liquid port 1102. In other embodiments, the liquid may be fed via gravity to the pump 1106. The liquid emission bracket 110 is preferably interposed between a first louver slat assembly 504, a second louver slat assembly 506, a third louver slat assembly 508, and a fourth louver slat assembly 510 that are each coupled to the housing 102 and form a part of the front face 500 thereon. The assembly 100 may also include a gas container 1200 disposed within the liquid reservoir 1100. The gas container 1200 may include a gas, e.g., propane, and is operably configured to emit a gas therefrom for ignition and creation of a pilot flame or other flame configured to warm air that utilized in the airflow generated by the wheel members 1300 (FIG. 13). In one embodiment, the gas container 1200 has a manually actuated valve configured to cause emission of the gas. In other embodiments, the gas container 1200 has an electronic valve 1906 operably coupled thereto and communicatively coupled to the electronic controller 1902 for selective opening and closing of the valve and emission or non-emission of the gas, respectively.

Figure 17:
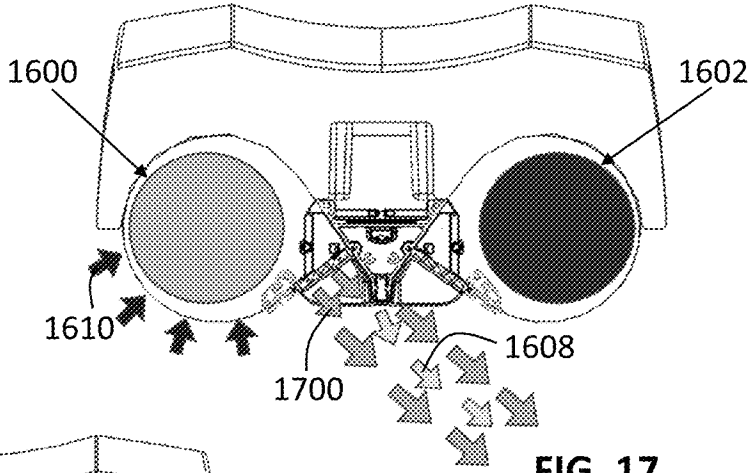
FIG. 17 is a top plan fragmentary view of the mobile climate control assembly in FIG. 1 in a second operational air emission position in accordance with one embodiment of the present invention.
Figure 16:
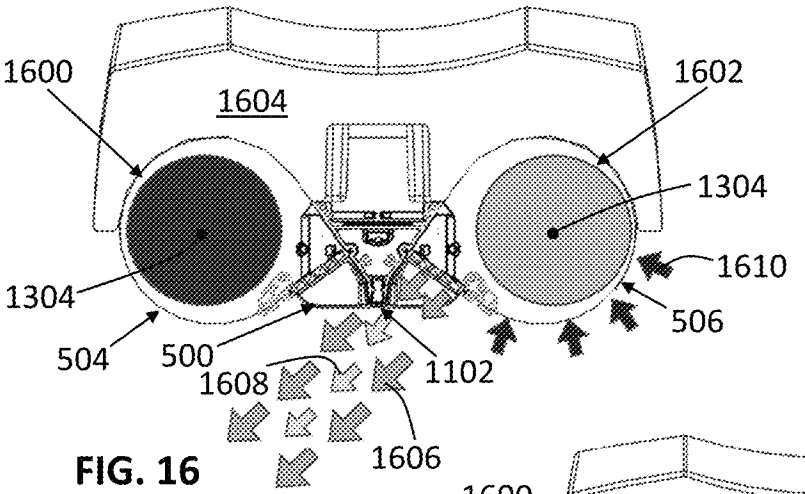
FIG. 16 is a top plan fragmentary view of the mobile climate control assembly in FIG. 1 in a first operational air emission position in accordance with one embodiment of the present invention.
Figure 18:
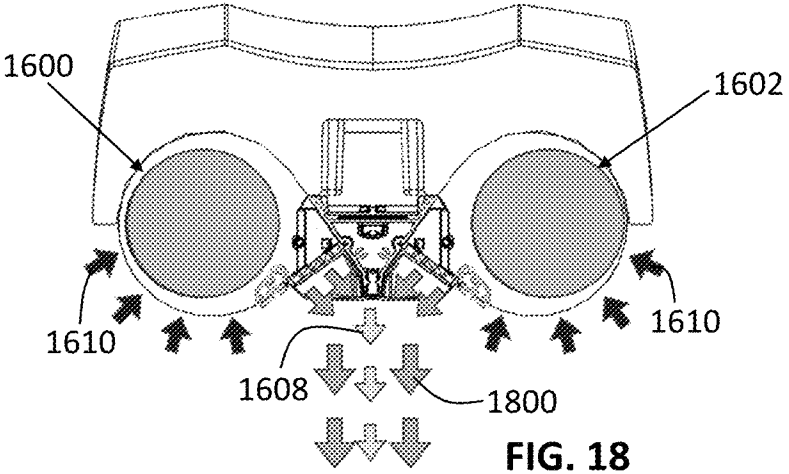
FIG. 18 is a top plan fragmentary view of the mobile climate control assembly in FIG. 1 in a third operational air emission position in accordance with one embodiment of the present invention.
Figure 19:
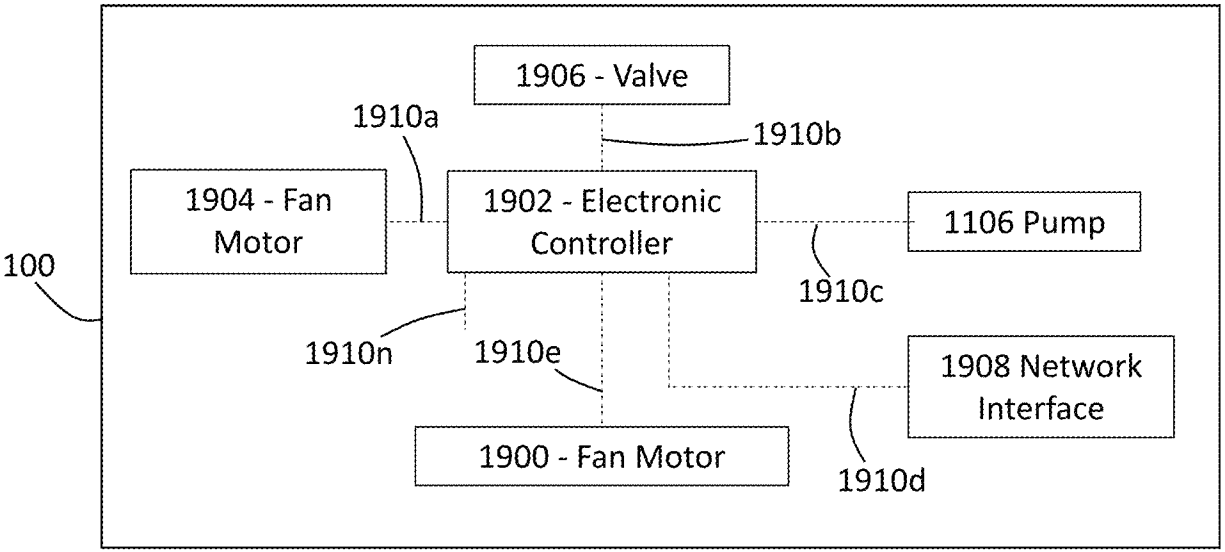
FIG. 19 is a schematic block diagram of the mobile climate control assembly in accordance with one embodiment of the present invention.

As seen in FIGS. 16-19, airflow vectors 1606 are depicted (along with at an approximate +55° relative to center (FIG. 16), −55° relative to center (FIG. 17), and 0° relative to center (FIG. 18). FIGS. 16-17 depict relative extremes of the traverse airflow path, but the assembly 100 is operably configured to generate various airflow directions and oscillations with selective rotational speed of one or both of the wheel members 1300. In one embodiment, the electronic controller 1902 may utilize one or more programs configured to selectively control the activation and rotational speed of the wheel members 100 of one or both of the first and/or second blower-wheel assemblies 1600, 1602 to generate desired airflows and airflow patterns. In other embodiments, the electronic controller 1902 may be manually operated by the user. Said another way, the electronic controller 1902 is operably configured and programable to selectively communicate a signal the one or more fan motors 1904 operably coupled to the wheel members 1300, the pump 1106, and other electrical components within the assembly. The exemplary communication channels (which may be wired or wireless) are depicted in FIG. 19 as communication lines 1910*a-n*, wherein "n" represents any number greater than two and depends on the number of electrical components utilized by the assembly 100 and desired to be communicatively coupled to the controller(s) 1902.

As seen in FIG. 16, the electronic controller 1904 is causing solely a first fan motor 1900 to rotate the wheel member 1300 of the second fan blower-wheel assembly 1602, thereby generating a first operational air emission position with an ambient air velocity gradient (i.e., a difference in airflow respect to the ambient airflow outside of the housing 102) and a first air vector 1606 (or airflow) away from the front face 500 of the housing 102. As seen in FIG. 17, the electronic controller 1904 is causing solely a second fan motor 1900 to rotate the wheel member 1300 of the first fan blower-wheel assembly 1600, thereby generating a second operational air emission position with an ambient air velocity gradient and a first air vector 1606 (or airflow) away from the front face 500 of the housing 102. Contrasting FIG. 16 and FIG. 17, the first air vector 1606 is oriented at least approximately 90° (or 110° as depicted in the figures) with respect to the second air vector 1700. As seen in FIG. 18, the electronic controller 1904 is causing both the first and second motors 1904 to rotate the wheel member 1300 of the first and second fan blower-wheel assemblies 1600, 1602, thereby generating a third operational air emission position with an ambient air velocity gradient and a third air vector 1800 away from the front face 500. As seen in FIG. 18, the third air vector 1800 is a convergence of the first and second air vectors 1606, 1700 and oriented in a direction lying at an approximate mid-point (or center orientation) between the first and second air vectors 1606, 1700. In some embodiments, the third air vector 1800 is of a greater magnitude than a magnitude of the first and second air vectors 1606, 1700.

Figure 5:
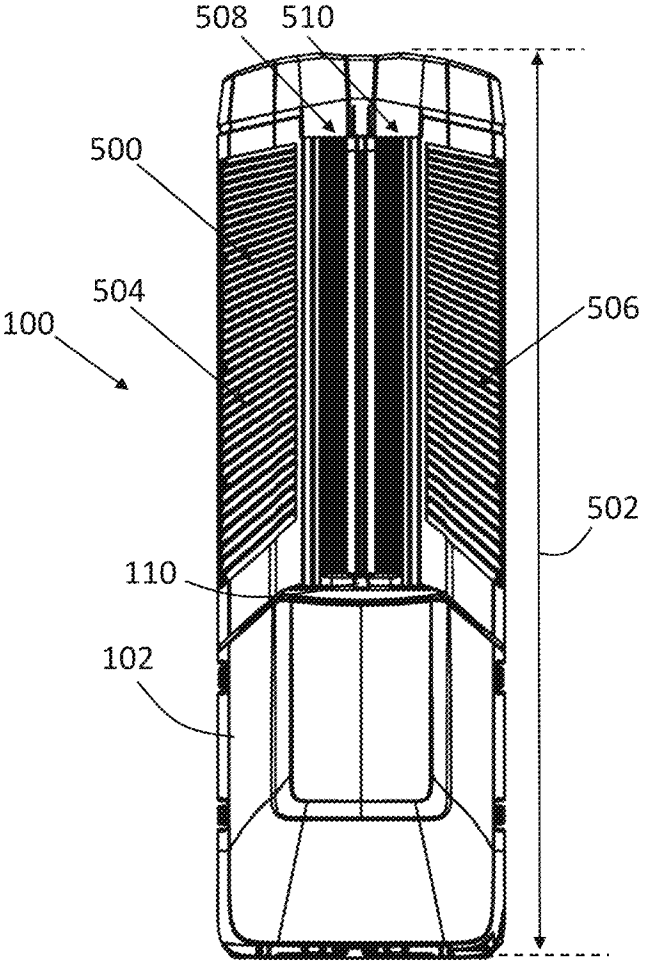
FIG. 5 is an elevational front view of the mobile climate control assembly in FIG. 1.
Figure 9:
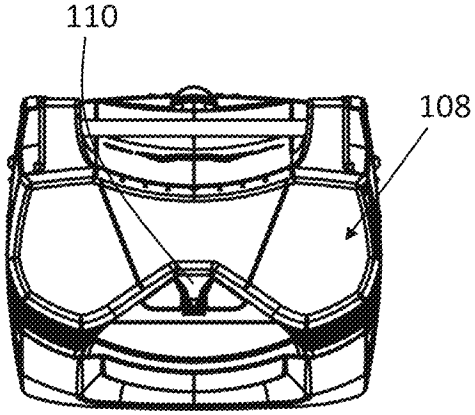
FIG. 9 is a top plan view of the mobile climate control assembly in FIG. 1.
Figure 10:
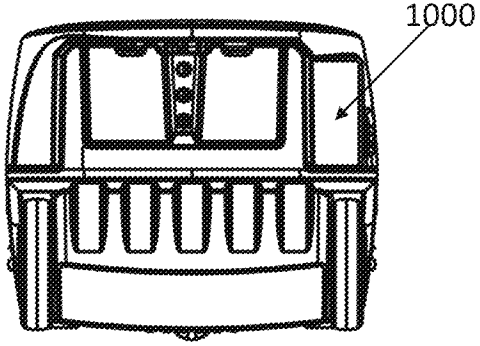
FIG. 10 is a bottom plan view of the mobile climate control assembly in FIG. 1.
Figure 8:
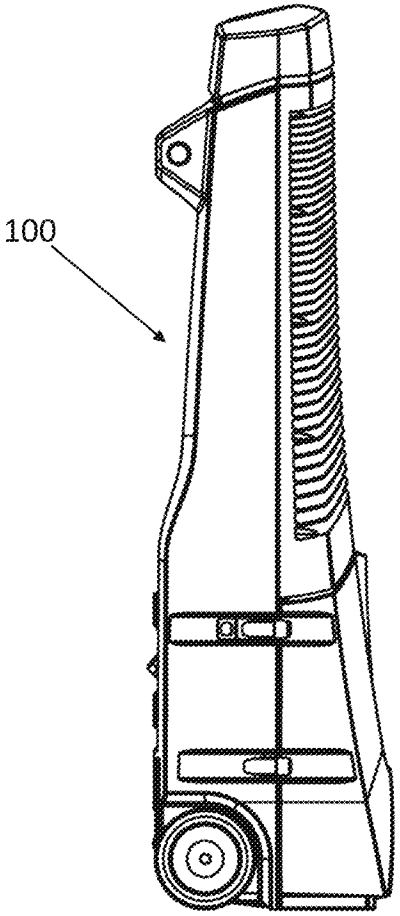
FIG. 8 is an elevational left-side view of the mobile climate control assembly in FIG. 1.
Figure 7:
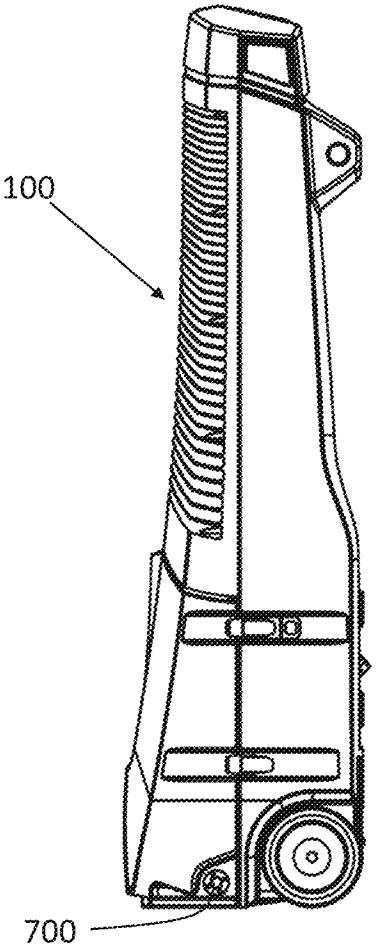
FIG. 7 is an elevational right-side view of the mobile climate control assembly in FIG. 1.

With reference to FIG. 5 and FIGS. 14-15, each of the fan blower-wheel assemblies 1600, 1602 may include a secondary air deflector wall 1402 coupled to the housing 102 and surrounding a partial circumference of the wheel member 1300. The secondary air deflector wall 1402 facilitates in focusing and directing ambient air through the wheel member 1300 of the fan blower-wheel assemblies 1600, 1602. The secondary air deflector wall 1402 has a front end portion 1502 disposed proximal to the front face 500 of the housing 102 and configured, with the front end portion 1500 of the air deflector wall 1400, to direct air generated from the wheel member 1300 outwardly away from the front face 500 of the housing 102. The front-end portions 1500, 1502 of the air deflector wall 1400 and the secondary air deflector wall 1402, respectively, may also define an air exit port 1508.

The first fan blower-wheel assembly 1600 and the second fan blower assembly 1602 may each also include a rear end portion 1504 on the air deflector wall 1400 and a rear end portion 1506 on the secondary air deflector wall 1402, wherein the rear end portions 1504, 1506 of the air deflector wall 1400 and the secondary air deflector wall 1402, respectively, define an air intake port 1510. The air intake port may also be disposed proximal to the front face 500 of the housing 102 and configured to direct ambient air through the wheel member 1300 and the air exit port 1508. The configuration and orientation of the air deflector wall 1400 and secondary air deflector wall 1402, which may span the length of the wheel member 1300, beneficially facilitate in generating an airflow with minimizing airflow velocity losses.

The housing 102 also beneficially includes the first louver slat assembly 504 defining a portion of the front face 500 and being adjacently aligned with the air intake port 1510 of the first fan blower-wheel assembly 1600. The second louver slat assembly 506 may define a portion of the front face 500 and is adjacently aligned with the air intake port 1510 of the second fan blower-wheel assembly 1602. The third louver slat assembly 508 may define a portion of the front face 500 and is adjacently aligned with the air exit port 1508 of the first fan blower-wheel assembly 1600. The fourth louver slat assembly 510 may define a portion of the front face 500 and is adjacently aligned with the air exit port 1508 of the second fan blower-wheel assembly 1602. The first and second louver slat assemblies 504, 506 are interposed by the third and fourth louver slat assemblies 508, 510. The louver slat assemblies 504, 506, 508, 510 are also preferably made of a substantially rigid and durable material, e.g., ABS plastic.

Referring back to FIGS. 16-18, the first and second fan blower-wheel assemblies 1600, 1602 can also be seen beneficially causing the transportation (represented with arrows 1608) of liquid vapor substance along with the airflow. As such, an evaporative cooling effect (or warming effect if a gas is utilized to warm the air) is generated seamlessly, effectively, and efficiently. Intake air vectors (represented with arrows 1610) are also shown for visually depicting exemplary airflow in some operational positions of the first and second fan blower-wheel assemblies 1600, 1602.

The one or more fan motors 1900 may be selectively couplable to a power source, e.g., 120 A/C, and may also include a driver for converting A/C power to D/C power. In other embodiments, the power source may be locally resident on the housing 102. In one embodiment, the assembly 100 employs the use of a retractable/extendable power line cord. In preferred embodiments, the electrical components of the assembly 100 utilize less than 1500 watts.

Figure 4:
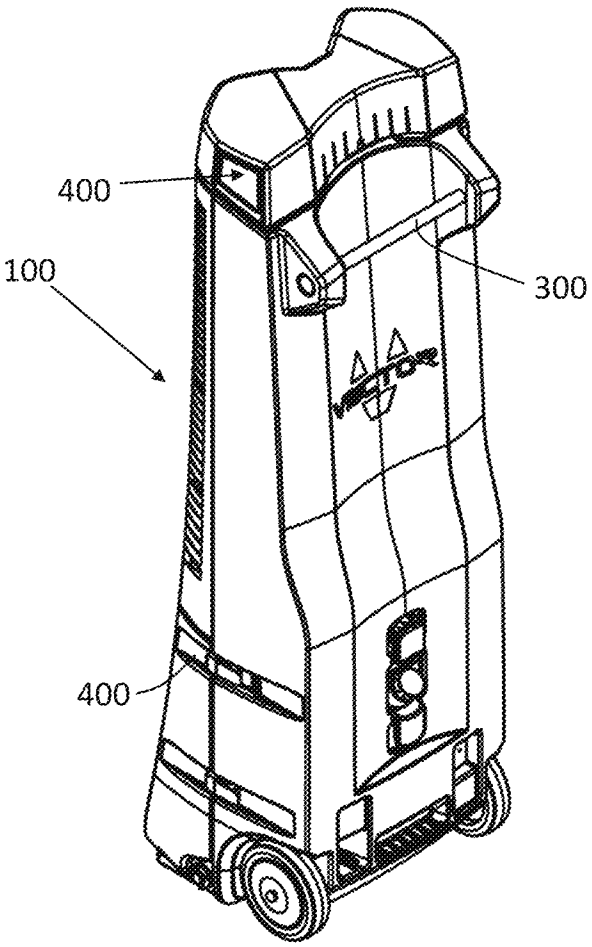
FIG. 4 is a perspective right-side rear view of the mobile climate control assembly in FIG. 1.
Figure 3:
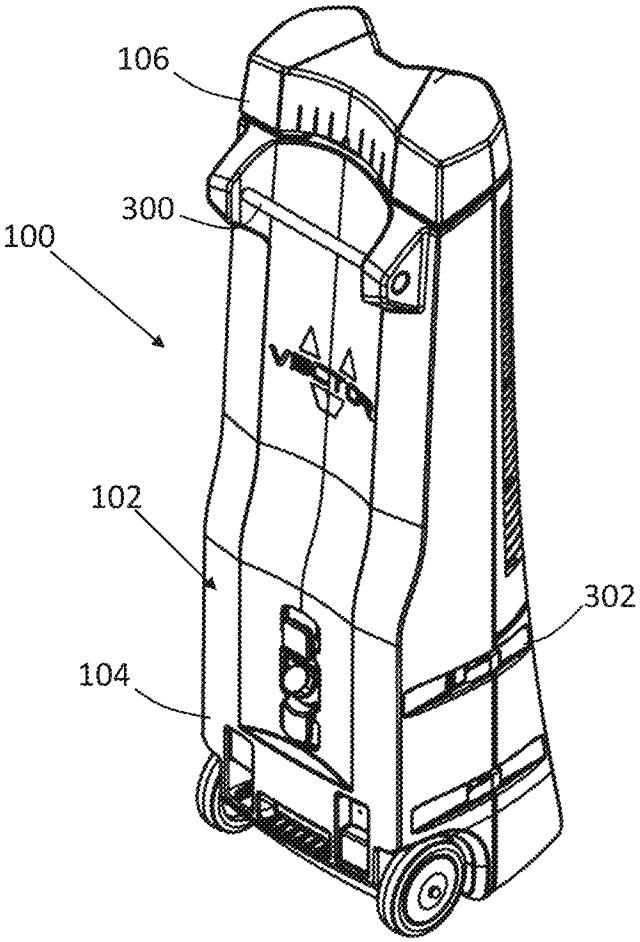
FIG. 3 is a perspective left-side rear view of the mobile climate control assembly in FIG. 1.
Figure 6:
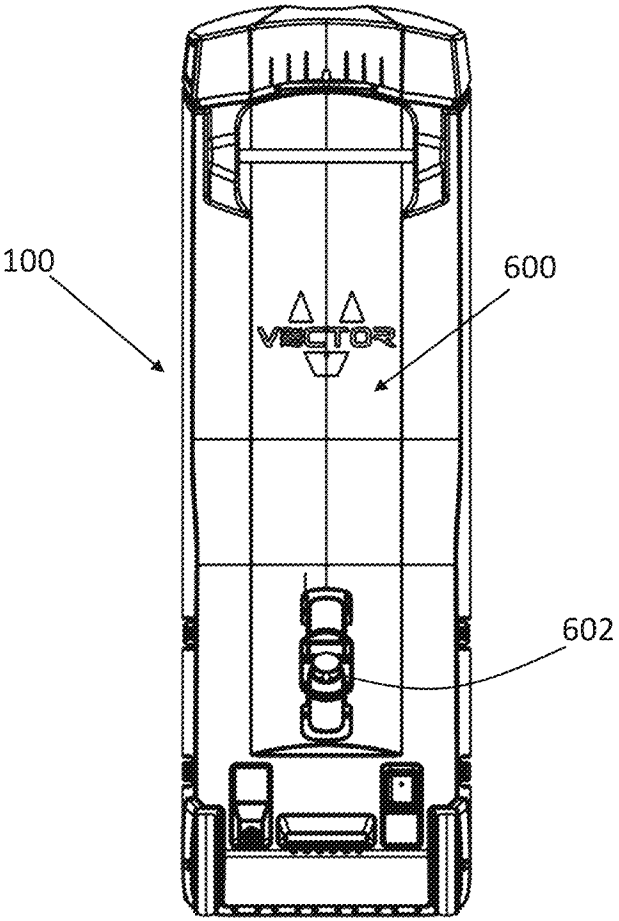
FIG. 6 is an elevational rear view of the mobile climate control assembly in FIG. 1.

With reference to FIG. 4 and FIG. 19, the functional operation of the assembly 100 may be completely controlled through a software application communicatively coupled to the electronic controller 1902 through, for example, a network interface 1908 resident within the housing 102. In other embodiments, the functional operation of the assembly 100 may controlled manually by the user using on or more button(s) and/or switch(es) disposed on the housing 102. In other embodiments, control of the assembly 100 may be combination of manual control and/or computer control. To that end, the housing 102 or a mobile computing device may include a user input interface (e.g., interface 400), a network interface (e.g., interface 1908), a memory, a processing device (e.g., the electronic controller 1902), an electronic display (e.g., display 400), an audio input/output, and a location detection device. The user input interface functions to provide a user a method of providing input to the memory and/or electronic controller 1902. The user input interface may also facilitate interaction between the user and other components of the assembly 100. The user input interface may be a keypad providing a variety of user input operations. For example, the keypad may include alphanumeric keys for allowing entry of alphanumeric information. The user input interface may include special function keys (e.g. oscillation speed, airflow velocity, etc.), navigation and select keys, a pointing device, and the like. Keys, buttons, and/or keypads may be implemented as a touchscreen associated with the electronic display. The touchscreen may also provide output or feedback to the user, such as haptic feedback or orientation adjustments of the keypad according to sensor signals received by motion detectors, such as an accelerometer, located within the assembly 100.

The network interface(s) 1908 may include one or more network interface cards (NIC) and/or a network controller. In some embodiments, the network interface 1908 may include a personal area network (PAN) interface. The PAN interface may provide the capability for the electronic controller 1902 to join network using a short-range communication protocol, for example, a Bluetooth communication protocol. The PAN interface may permit electronic devices on the assembly 100 to connect wirelessly to another electronic mobile device or component via a peer-to-peer connection. The network interface(s) 1908 may also include a local area network (LAN) interface. The LAN interface may be, for example, an interface to a wireless LAN, such as a Wi-Fi network. In one embodiment, there is a wireless LAN that provides electronic components with access to the Internet for receiving and sending inputs, over the Internet. The range of the LAN interface may generally exceed the range available via the PAN interface. Typically, a connection between two electronic devices via the LAN interface may involve communication through a network router or other intermediary device.

Additionally, the network interface(s) 1908 may include the capability to connect to a wide area network (WAN) via a WAN interface. The WAN interface may permit a connection to a cellular mobile communications network. The WAN interface may include communications circuitry, such as an antenna coupled to a radio circuit having a transceiver for transmitting and receiving radio signals via the antenna. The radio circuit may be configured to operate in a mobile communications network, including but not limited to global systems for mobile communications (GSM), code division multiple access (CDMA), wideband CDMA (WCDMA), and the like.

The memory associated with the assembly 100 may be, for example, one or more buffer, a flash memory, or non-volatile memory, such as random-access memory (RAM). The assembly 100 may also include non-volatile storage. The non-volatile storage may represent any suitable storage medium, such as a hard disk drive or non-volatile memory, such as flash memory.

A processing device resident in the assembly can be, for example, a central processing unit (CPU), a microcontroller, or a microprocessing device, including a "general purpose" microprocessing device or a special purpose microprocessing device. The processing device executes code stored on the memory in order to carry out operation/instructions of the assembly 100. The processing device may provide the processing capability to execute an operating system, run various applications, and provide processing for one or more of the techniques and process steps described herein.

The electronic display displays information to the user such as an operating state and parameters, time, application icons, pull-down menus, and the like. The electronic display may be used to present various images, text, graphics, or videos to the user. The electronic display may be any type of suitable display, such as a liquid-crystal display (LCD), a plasma display, a light-emitting diode (LED) display, or the like. The electronic display may display the mobile application for controlling the assembly in accordance with one embodiment of the present invention.

The assembly may include audio input and output structures, such as a microphone for receiving audio signals from a user and/or a speaker for outputting audio data. An ambient temperature sensor may also be utilized in addition to the location detection device, wherein the location detection device may be associated with a global positioning system (GPS) or other location sensing technologies. The assembly 100 may have a GPS receiver or the like, to determine the location of the assembly 100. Such temperature sensor(s) and GPS location information of the assembly 100 may be useful for certain features of embodiments of the present invention, such as, for example, autonomously increasing or decreasing liquid output or airflow velocity (speed and/or direction) based on environmental conditions (e.g., drop/increase in environmental ambient temperature).

Various modifications and additions, however, can be made to the exemplary embodiments discussed above without departing from the scope of the present disclosure. For example, while the embodiments described above refer to particular features, the scope of this disclosure also includes embodiments having different combinations of features and embodiments that do not include all of the above described features. Moreover, although a specific order of executing the operational process steps has been discussed, the order of executing the steps may be changed relative to the order shown in certain embodiments. Also, two or more steps described or shown occurring in succession may be executed concurrently or with partial concurrence in some embodiments. Certain steps may also be omitted for the sake of brevity. In some embodiments, some or all of the process steps can be combined into a single process.

What is claimed is:

1. A mobile climate control assembly comprising:

at least one portable housing with a base, a front face, and a rear face opposing the front face;

a first fan blower-wheel assembly and a second fan blower assembly each respectively having:

a wheel member with a plurality of wheel blades disposed circumferentially around the wheel member and operably configured to rotate 360° around an axis of rotation parallel and non-co-planar with respect to one another; and an air deflector wall coupled to the at least one portable housing and-surrounding a partial circumference of the wheel member and having a front end portion disposed proximal to the front face of the at least one portable housing and configured to direct air generated from the wheel member outwardly away from the front face of the at least one portable housing;

a first motor operably coupled to a bottom end of the wheel member of the first fan blower-wheel assembly and a second motor operably coupled to a bottom end of the wheel member of the second fan blower-wheel assembly; and an electronic controller communicatively coupled to the at least one fan motor and operably configured:

to independently and selectively control rotation of the wheel member of each of the first and second fan blower-wheel assemblies to generate an ambient air velocity gradient along at least an approximate 90° angular traverse path from the front face and without rotation of the front end portion of the air deflector wall and the at least one portable housing; and programable to selectively communicate a signal:

solely to the first motor, cause rotation of the wheel member of the second fan blower-wheel assembly, and generate a first operational air emission position with an ambient air velocity gradient and a first air vector away from the front face;

solely to the second motor, cause rotation of the wheel member of the second fan blower-wheel assembly, and generate a second operational air emission position with an ambient air velocity gradient and a second air vector away from the front face, the first air vector oriented at least approximately 90° with respect to the second air vector; and to both the first and second motors, cause rotation of the wheel member of the first and second fan blower-wheel assemblies, and generate a third operational air emission position with an ambient air velocity gradient and a third air vector away from the front face, the third air vector a convergence of the first and second air vectors and oriented in a direction lying at an approximate mid-point between the first and second air vectors.

2. The mobile climate control assembly according to claim 1, further comprising:

the at least one portable housing having a base coupled thereto, an upper end, a lower end opposing the upper end of the at least one portable housing, a housing length separating the upper and lower ends, defining a housing cavity; and a plurality of serially aligned wheel members on each of the first and second fan blower-wheel assemblies, respectively, and with the axis of rotation for each that is oriented in a longitudinal direction spanning along the housing length, the first fan blower-wheel assembly and the second fan blower assembly each respectively having the wheel member disposed within the housing cavity and having a front end portion disposed proximal to the front face of the at least one portable housing.

3. The mobile climate control assembly according to claim 2, wherein the plurality of serially aligned wheel members of the first fan blower-wheel assembly and the second fan blower assembly each further comprise:

a top end, a bottom end opposing the top end, and a wheel length separating the top and bottom ends, the air deflector wall spanning the wheel length.

4. The mobile climate control assembly according to claim 1, wherein the wheel member of the first fan blower-wheel assembly and the second fan blower assembly each further comprise:

a top end, a bottom end opposing the top end, and a wheel length separating the top and bottom ends, the air deflector wall spanning the wheel length.

5. The mobile climate control assembly according to claim 1, wherein:

the third air vector is of a greater magnitude than a magnitude of the first and second air vectors.

6. The mobile climate control assembly according to claim 2, wherein the first fan blower-wheel assembly and the second fan blower assembly each further comprise:

a secondary air deflector wall coupled to the at least one portable housing and surrounding a partial circumference of the wheel member and having a front end portion disposed proximal to the front face of the at least one portable housing and configured, with the front end portion of the air deflector wall, to direct air generated from the wheel member outwardly away from the front face of the at least one portable housing, the front end portions of the air deflector wall and the secondary air deflector wall, respectively, defining an air exit port.

7. The mobile climate control assembly according to claim 6, wherein the first fan blower-wheel assembly and the second fan blower assembly each further comprise:

a rear end portion on the air deflector wall and a rear end portion on the secondary air deflector wall, the rear end portions of the air deflector wall and the secondary air deflector wall, respectively, defining an air intake port disposed proximal to the front face of the at least one portable housing and configured to direct ambient air through the wheel member and the air exit port.

8. The mobile climate control assembly according to claim 7, wherein the at least one portable housing further comprises:

a first louver slat assembly defining a portion of the front face and adjacently aligned with the air intake port of the first fan blower-wheel assembly, a second louver slat assembly defining a portion of the front face and adjacently aligned with the air intake port of the second fan blower-wheel assembly, a third louver slat assembly defining a portion of the front face and adjacently aligned with the air exit port of the first fan blower-wheel assembly, and a fourth louver slat assembly defining a portion of the front face and adjacently aligned with the air exit port of the second fan blower-wheel assembly, the first and second louver slat assemblies interposed by the third and fourth louver slat assemblies.

9. The mobile climate control assembly according to claim 8, wherein the at least one portable housing further comprises:

a liquid reservoir defined by, and operably configured to house a liquid, therein;

a liquid emission bracket defining at least one liquid port thereon and fluidly coupled to the liquid reservoir; and a pump fluidly coupled to the liquid reservoir and operably configured to induce a pressurized flow of the fluid housed in the liquid reservoir through the at least one liquid port.

10. The mobile climate control assembly according to claim 9, wherein:

the liquid emission bracket is interposed between the first and second louver slat assemblies.

11. The mobile climate control assembly according to claim 9, wherein the at least one portable housing further comprises:

a selectively removable liquid basin formed in the base of the housing;

at least one wheel disposed at the lower end and the rear face of the housing; and a handle member disposed at the rear face of the at least one portable housing.

12. The mobile climate control assembly according to claim 9, wherein the at least one portable housing further comprises:

a liquid reservoir defined within the base of the at least one portable housing and with a gas container disposed therein, the gas container having an electronic valve operably coupled thereto and communicatively coupled to the electronic controller.

13. A mobile climate control assembly comprising:

a portable housing with a base coupled thereto, an upper end, a lower end opposing the upper end of the housing, a housing length separating the upper and lower ends, defining a housing cavity, a front face, and a rear face opposing the front face;

a first fan blower-wheel assembly and a second fan blower assembly each respectively having:

a wheel member disposed within the housing cavity and with a bottom end and a plurality of wheel blades disposed circumferentially around the wheel member and operably configured to rotate 360° around an axis of rotation; and an air deflector wall coupled to the housing and surrounding a partial circumference of the wheel member and having a front end portion disposed proximal to the front face of the housing and configured to direct air generated from the wheel member outwardly away from the front face of the housing;

a first motor operably coupled to the bottom end of the wheel member of the first fan blower-wheel assembly and a second motor operably coupled to the bottom end of the wheel member of the second fan blower-wheel assembly; and an electronic controller communicatively coupled to the first and second fan motors and operably configured and programable to selectively communicate a signal:

solely to the first motor, cause rotation of the wheel member of the second fan blower-wheel assembly, and generate a first operational air emission position with an ambient air velocity gradient and a first air vector away from the front face;

solely to the second motor, cause rotation of the wheel member of the second fan blower-wheel assembly, and generate a second operational air emission position with an ambient air velocity gradient and a second air vector away from the front face, the first air vector oriented at least approximately 90° with respect to the second air vector;

to both the first and second motors, cause rotation of the wheel member of the first and second fan blower-wheel assemblies, and generate a third operational air emission position with an ambient air velocity gradient and a third air vector away from the front face, the third air vector a convergence of the first and second air vectors and oriented in a direction lying at an approximate mid-point between the first and second air vectors; and to each of the first and second fan blower-wheel assemblies to generate an ambient air velocity gradient along at least an approximate 90° angular traverse path from the front face and without rotation of the front end portion of the air deflector wall and the portable housing.

14. The mobile climate control assembly according to claim 13, wherein:

the wheel member of both the first and second fan blower-wheel assemblies is operably configured to rotate 360° around an axis of rotation parallel and non-co-planar with respect to one another.

15. The mobile climate control assembly according to claim 14, wherein:

the electronic controller is operably configured to independently and selectively control rotation of the wheel member of each of the first and second fan blower-wheel assemblies to generate the ambient air velocity gradient along the at least an approximate 90° angular traverse path.

16. The mobile climate control assembly according to claim 15, wherein the first fan blower-wheel assembly and the second fan blower assembly each further comprise:

a secondary air deflector wall coupled to the housing and surrounding a partial circumference of the wheel member and having a front end portion disposed proximal to the front face of the housing and configured, with the front end portion of the air deflector wall, to direct air generated from the wheel member outwardly away from the front face of the housing, the front end portions of the air deflector wall and the secondary air deflector wall, respectively, defining an air exit port.

17. The mobile climate control assembly according to claim 16, wherein the first fan blower-wheel assembly and the second fan blower assembly each further comprise:

a rear end portion on the air deflector wall and a rear end portion on the secondary air deflector wall, the rear end portions of the air deflector wall and the secondary air deflector wall, respectively, defining an air intake port disposed proximal to the front face of the housing and configured to direct ambient air through the wheel member and the air exit port.

18. A mobile climate control assembly comprising:

a portable housing with:

a base coupled thereto, an upper end, a lower end opposing the upper end of the housing, a housing length separating the upper and lower ends, defining a housing cavity, a front face, and a rear face opposing the front face;

a liquid reservoir defined by, and operably configured to house a liquid, therein;

a liquid emission bracket defining at least one liquid port thereon and fluidly coupled to the liquid reservoir; and a pump fluidly coupled to the liquid reservoir and operably configured to induce a pressurized flow of the fluid housed in the liquid reservoir through the at least one liquid port;

a first fan blower-wheel assembly and a second fan blower assembly each respectively having:

a wheel member disposed within the housing cavity and with a plurality of wheel blades disposed circumferentially around the wheel member and operably configured to rotate 360° around an axis of rotation parallel and non-co-planar with respect to one another; and an air deflector wall coupled to the housing and surrounding a partial circumference of the wheel member and having a front end portion disposed proximal to the front face of the housing and configured to direct air generated from the wheel member outwardly away from the front face of the housing;

at least one fan motor operably coupled to the wheel member of each of the first and second fan blower-wheel assemblies; and an electronic controller communicatively coupled to the at least one fan motor and operably configured to independently and selectively control rotation of the wheel member of each of the first and second fan blower-wheel assemblies to generate an ambient air velocity gradient along at least an approximate 90° angular traverse path from the front face and without rotation of the front end portion of the air deflector wall and the portable housing.

* * * * *